United States Patent [19]

Johnson

[11] Patent Number: 4,483,644

[45] Date of Patent: Nov. 20, 1984

[54] CANTILEVERED MOBILE MARINE RIG WITH HYDRAULIC LOAD EQUALIZER

[76] Inventor: Thomas P. Johnson, P.O. Box 246, Orange, Tex. 77630

[21] Appl. No.: 418,232

[22] Filed: Sep. 15, 1982

[51] Int. Cl.[3] ..... E02B 17/00

[52] U.S. Cl. ..... 405/201; 175/9

[58] Field of Search ..... 405/195, 196, 201, 291, 405/293, 302; 52/67; 175/7, 9; 248/354 H

[56] References Cited

U.S. PATENT DOCUMENTS

| | | | |
|---|---|---|---|
| 3,001,594 | 9/1961 | Suderow | 405/201 X |
| 3,240,021 | 3/1966 | Meriaux et al. | 405/294 |
| 3,477,235 | 11/1969 | Branham et al. | 405/201 |
| 3,889,481 | 6/1975 | Weirich et al. | 405/302 X |
| 4,158,326 | 6/1979 | Krieger | 405/302 X |
| 4,401,398 | 8/1983 | Remson | 405/201 |

*Primary Examiner*—David H. Corbin

*Attorney, Agent, or Firm*—Hubbard, Thurman, Turner & Tucker

[57] ABSTRACT

Disclosed is a cantilever mobile marine rig with hydraulic load equalizer. The rig includes a deck structure and a cantilever assembly slidingly mounted on the deck structure. The hydraulic load equalizer includes a plurality of hydraulic cylinder and piston assemblies positioned between the deck structure and the cantilever assemblies. The hydraulic cylinder and piston assemblies each have substantially the same effective area and are interconnected so as to allow substantially free and unimpeded flow of hydraulic fluid among the cylinder and piston assemblies.

14 Claims, 6 Drawing Figures

CANTILEVERED MOBILE MARINE RIG WITH HYDRAULIC LOAD EQUALIZER

BACKGROUND OF THE INVENTION

1. Field of the Invention

The present invention relates generally to mobile marine structures, and more particularly to a mobile marine structure having a cantilever assembly extendable over the side of the structure with hydraulic load equalizer apparatus for distributing stresses between the cantilever assembly and the structure.

2. Description of the Prior Art

In the drilling of oil and gas wells in a marine environment, a number of mobile structures or rigs have been developed. A particularly useful rig for drilling in relatively shallow water is the jack-up rig. A jack-up includes a floatable hull with at least three vertically extendable legs. The rig is floated to the drill site and then the legs are extended to contact the sea bottom and raise the hull out of the water, thus providing a stable platform from which drilling operations may be conducted.

An improvement in the jack-up rig field is what is known as the cantilever rig. Cantilever rigs are generally jack-up rigs that have the well drilling equipment mounted on a cantilever assembly which is slidingly mounted on the deck of the structure, but submersibles, bottle stabilized, posted and other types may also use the cantilever. The cantilever rig is spotted adjacent the drill site and the drilling equipment may be moved onto and off of the actual drill site without moving the rig.

A problem with cantilever rigs has to do with the tremendous stress concentrations between the cantilever assembly and the outward edge of the rig. The loading on the cantilever end of the cantilever assembly, including the weight of the derrick, drawworks, related pipe handling equipment, and load on the hook, can amount to thousands of tons. That weight is counter balanced by a hold-down structure holding down the opposite end of the cantilever assembly. While, in common experience the massive horizontally extending steel beams of the cantilever assembly are thought to be rigid, with such tremendous loadings, the beams actually flex or bend. Thus, the cantilever beams are not supported on the deck of the rig for their entire inboard length. Rather, the area of contact between the loaded cantilever beams and the deck is quite small and approximates a fulcrum or point support. Thus, the unit pressure on the loaded area of the beams and deck structure is extremely high. These extreme stress concentrations can result in gouging or galling of the metal surfaces during sliding, and in some cases to mechanical failure of the beams or deck.

An attempted solution of the stress concentration problem is provided in U.S. Pat. No. 3,477,235. In the structure of that patent, there is provided at the outboard edge of the deck a rocker bearing assembly. The rocker bearing assembly includes a rocking bearing plate pivotally mounted to the structure. The rocker bearing plate may thus pivot to conform to the bottom of the cantilever beam, thus spreading the stress over the entire length of the rocker bearing plate. However, the entire load on the rocker bearing plate is transferred to structure through the bearing. Thus, all of the stress is concentrated in the bearing.

In additional but related problem in cantilever rigs is in the fact that the outboard end of the cantilever assembly sags and is not level. Thus, the derrick is not vertical and the hoisting gear is not plumb with the center line of the well. While the structure of U.S. Pat. No. 3,477,235, provides some abatement of stress concentration on the beams, it provides no means for leveling the outboard end of the cantilever assembly.

It is therefore an object of the present invention to provide a uniform distribution of a heavy load over a large area, particularly the load between a cantilever beam and a supporting surface, thereby reducing the unit loading therebetween.

It is a further object of the present invention to provide a uniform distribution of the load within a wide range of angles of declivity of the loaded member.

It is a further object of the present invention to provide an apparatus for raising or jacking a supported load in such a way that the load is uniformly raised and uniformly supported while being raised.

It is a further object of the present invention to provide a load supporting system that can be adjusted manually with tools that are readily available in the field.

It is a yet a further object of the present invention to provide means for determining the magnitude of the load that is being supported.

SUMMARY OF THE INVENTION

Briefly stated, the foregoing and other objects of the present invention are achieved by positioning between the deck structure and the cantilever assembly, a plurality of horizontally spaced apart hydraulic piston and cylinder assemblies. Each hydraulic cylinder and piston assembly includes a cylinder having a piston reciprocably mounted therein for generally vertical movement. Each of the hydraulic cylinder and piston assemblies has substantially equal effective area, such that equal hydraulic pressures within the cylinder acting on the piston causes equal force to be generated.

The hydraulic cylinder and piston assemblies are hydraulically interconnected so as to allow free flow of hydraulic fluid among the assemblies. Thus, the pressure within all of the assemblies is substantially equal and each of the assemblies supports an equal portion of the load.

DESCRIPTION OF THE PREFERRED EMBODIMENT

Figure 1:
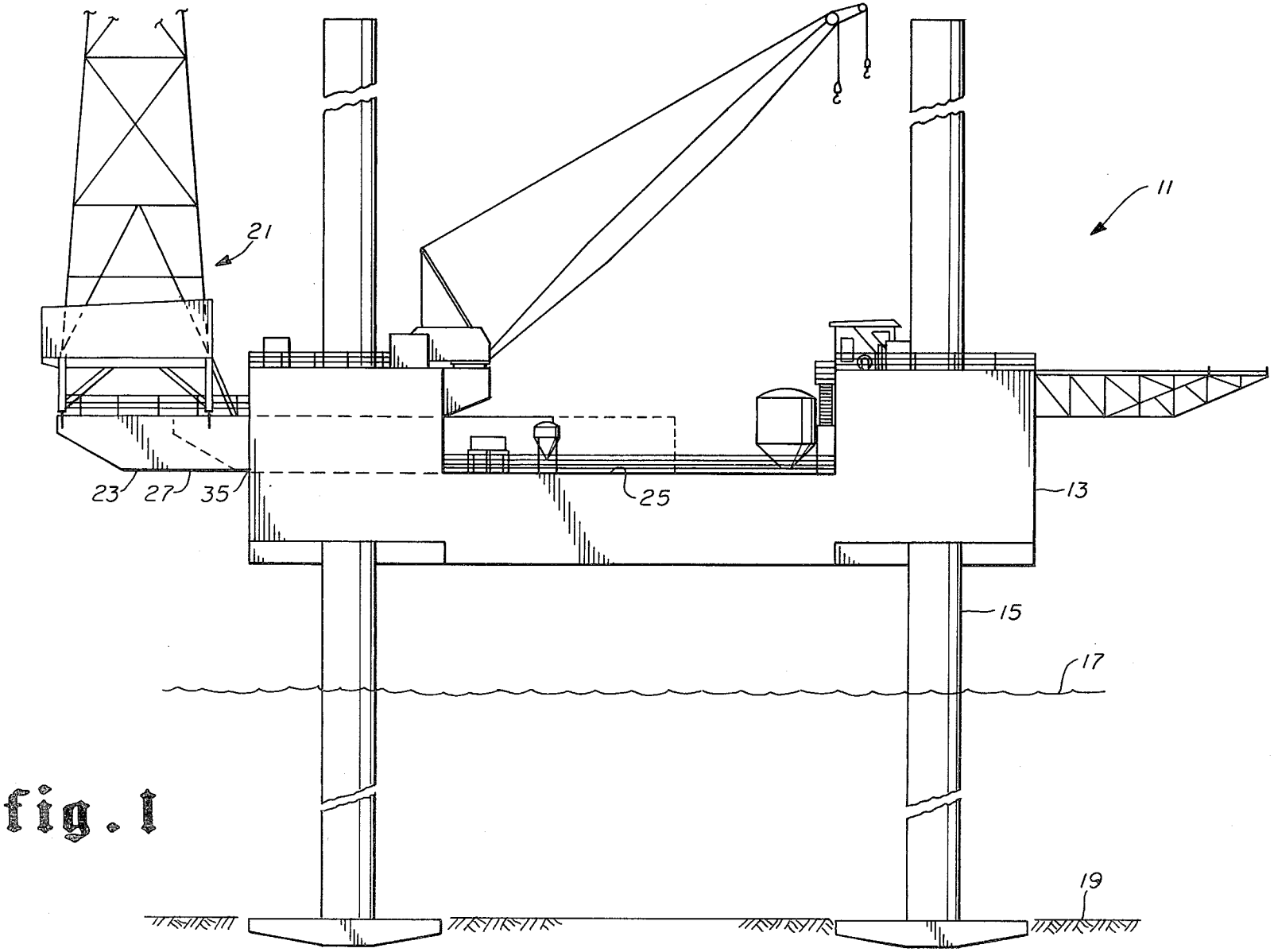
FIG. 1 is an elevation view of a preferred mobile marine structure of the present invention.
Figure 2:
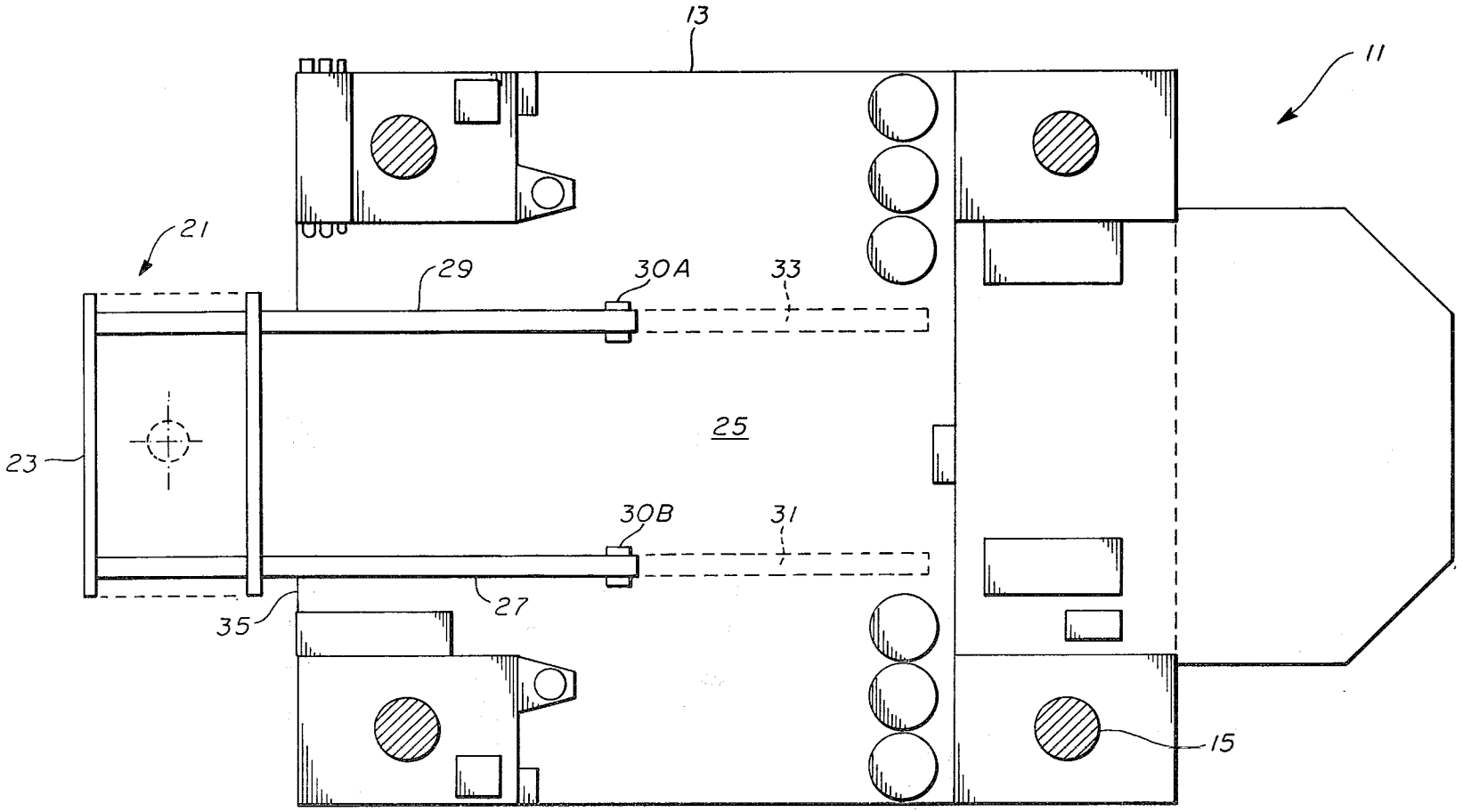
FIG. 2 is a plan view of the deck and cantilever assembly of the offshore structure of the present invention.

Referring now to the drawings, and first to FIGS. 1 and 2, there is shown a mobile marine structure which is designated generally by the numeral 11. Structure 11 is of the type commonly known as a jack-up rig, and includes a hull 13 and legs, including leg 15, which are vertically movably mounted in hull 13. Those skilled in the art will recognize that the system of the present invention may be used with other types of mobile marine structures. Structure 11 is adapted to be floated on the surface 17 of a body of water to a suitable drilling location. When structure 11 is on location, the legs are jacked downwardly to contact the bottom 19 to raise hull 13 clear of surface 17, as shown in FIG. 1. With structure 11 in the position depicted in FIG. 1, the hull is supported on the bottom to provide a stable platform.

Structure 11 is equipped with all equipment necessary for the drilling and completion of offshore oil and gas wells. The actual drilling equipment, which is designated generally by the numeral 21, and which generally includes a derrick, drawworks, rotary table, and pipe handling equipment, is mounted on a cantilever assembly 23 which is slidingly mounted on the deck structure 25 of structure 11 so that drilling equipment 21 may be positioned outboard of structure 11.

Referring particularly to FIG. 2, cantilever assembly 23 includes a pair of spaced apart parallel rigid beams 27 and 29. Beams 27 and 29 have mounted thereto at their outboard ends drilling equipment 21, and at a distance inboard from the edge overwhich the cantilever extends is a pair of massive hold-down fixtures 30*a* and 30*b* fixed to deck 25 thru which beams 27 and 29 can slide horizontally but not vertically, thus providing a counter balancing force for the weight of the drilling equipment 21 and the loads it exerts upon the beams 27 and 29. Beams 27 and 29 are slidingly mounted for horizontal movement on a pair of spaced apart tracks 31 and 33, respectively, which are mounted to deck 25.

While in common experience, massive steel beams of the type of beams 27 and 29 are considered rigid, when they support a cantilever load that may exceed 1,000 tons at a distance of as much as 45 feet or more, they are flexible. In actual practice, beams 27 and 29 flex or bend between hold-down fixtures 30*a* and 30*b* and drilling equipment 21, and the actual point of contact between beams 27 and 29 and deck structure 25 is a very narrow region in the vicinity of the outboard edge 35 of deck 25. The entire load is thus supported in the narrow region of contact, which leads to severe stress concentrations and which may result in damage to or failure of the structure or cantilever assembly.

Figure 4:
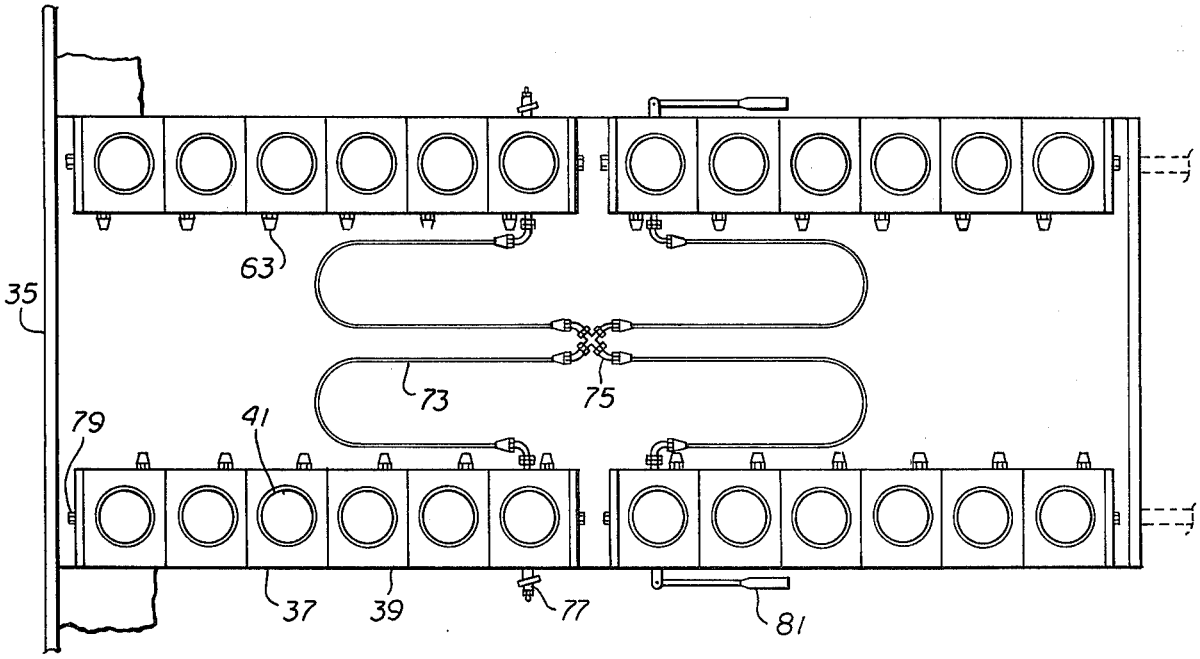
FIG. 4 is a top view of the load equalizer apparatus of the present invention.
Figure 3:
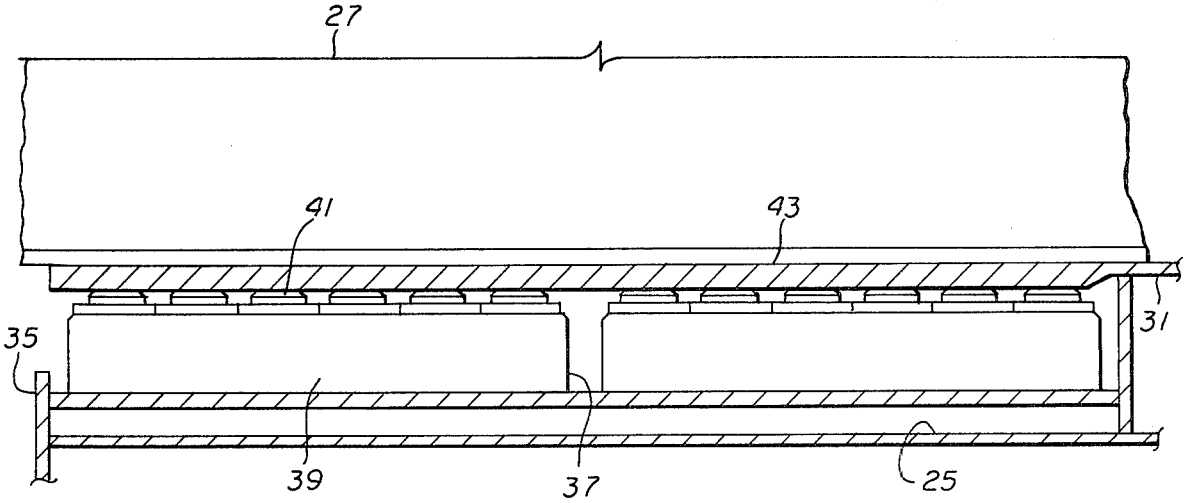
FIG. 3 is a side view of the load equalizer apparatus of the present invention.

Referring now to FIG. 3, there is shown the load equalizer assembly 37 of the present invention. Load equalizer 37 is positioned between deck structure 25 and beam 27 adjacent edge 35. In the preferred embodiment, as shown in FIG. 4, there are four load equalizer assemblies, which are substantially similar to load equalizer assembly 37, positioned beneath each of beam 27, it being understood that a similar array of load equalizer assemblies are positioned under beam 29. Load equalizer assembly 37 includes a unitary cylinder block 39 having disposed therein a plurality of pistons, as for example piston 41. A thick plate 43 is attached to and defines the outboard end of rail 31 and is positioned to conform to the bottom of beam 27 and transmit forces between beam 27 and the pistons, including piston 41.

Figure 5:
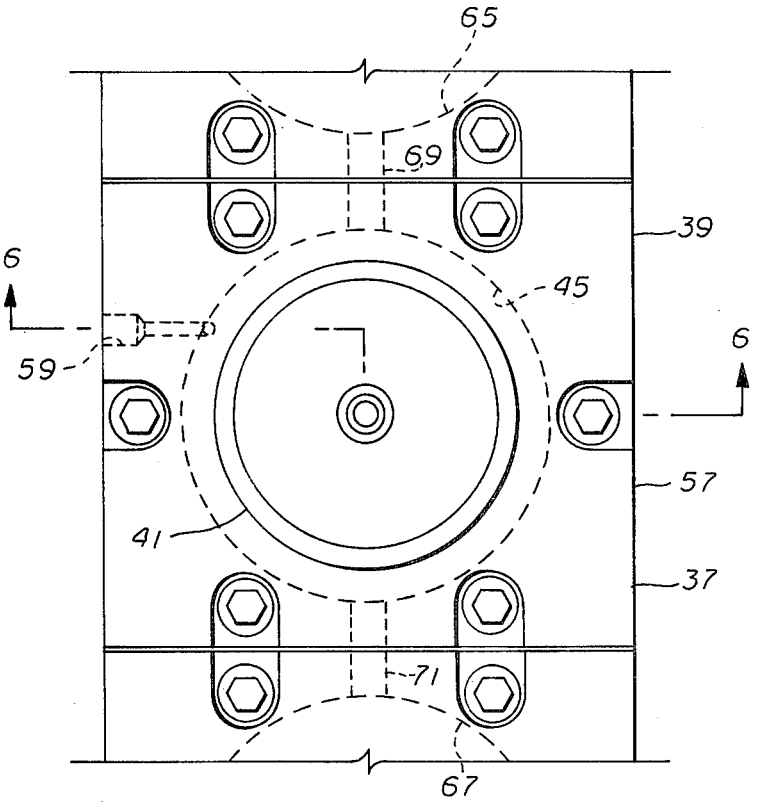
FIG. 5 is a detailed top view of a hydraulic cylinder and piston assembly of the equalizer of the present invention.
Figure 6:
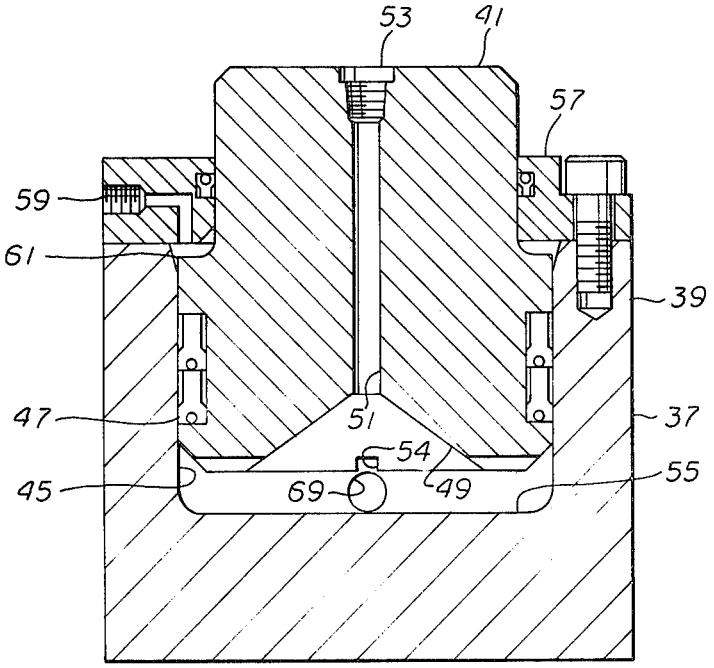
FIG. 6 is a section view taken generally along line 6—6 of FIG. 5 showing details of the hydraulic cylinder and piston assembly.

Referring now to FIGS. 5 and 6, there is shown the details of the construction of load equalizer assembly 37. Cylinder block 39 has formed therein a plurality of cylinders, including cylinder 45. Each of the cylinders has substantially equal diameter. Piston 41 is slidingly disposed within cylinder 45 and an array of annular seals, including seal 47, are provided to prevent the leakage of hydraulic fluid between cylinder 45 and piston 41. Piston 41 includes a frusto-conical bottom 49, which is connected to a bore 51 which, in operation, is plugged by a plug 53. Around the bottom of piston 41 there is disposed a plurality of radial passageways, including passageway 54, which allow for communication of hydraulic pressure to the bottom of piston 41 even when piston 41 is resting on the bottom 55 of cylinder 45.

In the preferred embodiment, the hydraulic fluid is general purpose lubricating grease. The grease is substantially incompressible and makes the system as nearly leak proof and creep resistent as possible. The frusto-conical bottom 49 and bore 51 allow the system to be purged of air, which is compressible. The system is purged by removing plug 53 and injecting grease into the system until it extrudes out of bore 51, whereupon plug 53 is reinserted.

In order to protect the surfaces of piston 41 and cylinder 45 from the harmful effects of dirt and seawater, a top cap 57 is attached to cylinder block 39 by bolts or the like. Top cap 57 is adapted to sealingly engage the upper portion of piston 41, and thereby prevent the entry of dirt or seawater into the area of sliding contact between piston 41 and cylinder 45. A vent 59 is provided in top cap 57 so as to allow the pressure between top cap 57 and the radially enlarged portion 61 of piston 41 to remain at atmospheric. As shown in FIG. 4, suitable exhaust port covers, including cover 63, are provided for covering the opened end of vent 59.

Referring still to FIGS. 5 and 6, adjacent cylinders within cylinder block 39 are interconnected by a passageway. For example, as shown in FIG. 5, cylinder 45 is connected to adjacent cylinders 65 and 67 by passageways 69 and 71 respectively. The passageways are thus arranged to interconnect all cylinders within cylinder block 39 and to provide free unimpeded flow of hydraulic fluid among all of the cylinders. Thus, the hydraulic pressure within each cylinder during operation is equal. Since the diameters of all of the cylinders and effective areas of the cylinder and piston assemblies are substantially equal, the force exerted by each piston will be substantially the same as that exerted by every other piston. If one piston is subjected to a greater load then any of the other pistons, then that piston will exert a greater force on the hydraulic fluid within its associated cylinder, which will force hydraulic fluid to flow within the system until all of the piston support equal load.

Referring again to FIG. 4, all of the load equalizer assemblies, including load equalizer assembly 37 that are positioned beneath each beam are interconnected, so as to allow free flow and unimpeded communication thereamong. The interconnection in the preferred embodiment is provided by a network of high pressure hoses, including hose 73 and a union cross which connects together all of the hoses. Thus, the load supported by each piston in the array of load equalizer assemblies is equal and, referring to FIG. 3, the stresses between beam 27 and deck structure 25 are spread over substantially the entire length of plate 43.

In order to introduce hydraulic fluid, which again is general purpose lubricating grease, to load equalizer assembly 37, a grease fitting 77 is provided. In the preferred embodiment, grease may be added to the system by means of a commonly available hand operated grease gun, which is rated at 5,000 psi design working pressure. An important feature of the present invention resides in the ease with which grease may be added to or taken from the system. By injecting grease into the system through grease fitting 77, all of the pistons are raised, thus raising beam 27. By raising beam 27 at the area of support, the outboard end of beam 27, which normally would have a slight downward slope, may be leveled, thereby allowing the hoisting equipment in the derrick to align precisely with the center line of the well.

Cylinder block 37 is provided with a pair of end plugs, including end plug 79, which is adapted to occlude a passageway that communicates with the cylinders of cylinder block 39. By removing end plug 79, further air may be purged during charging of the system with grease.

In the preferred embodiment, pressure gauges, as for example pressure gauge 81 may be connected to communicate with the hydraulic fluid within the array of load equalizer assemblies. Since the effective area of the cylinders and pistons of the load equalizer assemblies is known, the magnitude of the load supported may be readily calculated by multiplying the pressure read on gauge 81 by the total of the effective areas. Thus, the magnitude of the load may be continuously monitored.

From the foregoing it will be seen that this invention is one well adapted to attain all of the ends and objects hereinabove set forth together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof it is to be understood that all matters herein set forth are shown in the accompanying drawings as to be interpreted as illustrative and not in a limiting sense.

What is claimed:

1. A mobile marine rig, which comprises;

a deck structure having an outboard edge;

a cantilever assembly including well drilling means mounted at one end thereof, said cantilever assembly being slidingly mounted for horizontal movement on said deck structure to project said one end of said cantilever assembly beyond said outboard edge of said deck structure;

and a plurality of horizontally spaced apart cylinders of substantially equal diameter supported by said deck structure adjacent said outboard edge beneath said cantilever assembly, each of said cylinders having vertically slidingly mounted therein a piston arranged to transmit forces to said cantilever assembly, and means for supplying hydraulic fluid to and hydraulically interconnecting each of said cylinders to allow free flow of hydraulic fluid among said cylinders, thereby to equalize the pressure within each of said cylinders and equalize the force applied to said cantilever assembly by each of said pistons.

2. The mobile marine rig as claimed in claim 1, including means for adding hydraulic fluid to said hydraulic fluid supplying means for raising said cantilever assembly with respect to said deck structure.

3. The mobile marine rig as claimed in claim 1, including means for bleeding air from said cylinders.

4. The mobile marine rig as claimed in claim 1, including:

a unitary cylinder block having said plurality of cylinders formed therein;

a plurality of passages formed in said cylinder block wherein adjacent cylinders of said plurality of cylinders are connected by one of said passages.

5. The mobile marine rig as claimed in claim 4, wherein each of said cylinders has a bottom and said passages are positioned to supply hydraulic fluid to said cylinders adjacent said bottom and each of said pistons includes means for spacing the bottom of said piston apart from the bottom of said cylinder to allow hydraulic pressure always to act on said bottom of said piston.

6. The mobile marine rig as claimed in claim 5, wherein each of said pistons has formed therein a longitudinal bore connecting the bottom and top of said piston and means for plugging said bore.

7. The mobile marine rig as claimed in claims 6, wherein said piston includes a frusto-conical bottom surface intersecting said bore.

8. The mobile marine rig as claimed in claim 1, including means for measuring the pressure with said cylinders.

9. Apparatus for distributing stresses between a supporting surface and a supported surface which comprises:

a cylinder block;

a plurality of hydraulic cylinder and piston assemblies spaced apart in a plane and mountable between said supporting and supported surfaces, each of said assemblies including a cylinder formed in said cylinder block and a piston reciprocably mounted in said cylinder for movement normal to said plane to apply forces between said supporting and supported surfaces, each of said assemblies having substantially equal effective areas acted on by hydraulic fluid;

and passages in said cylinder block for hydraulically interconnecting said assemblies with each other to allow free flow of said hydraulic fluid among said assemblies, thereby to equalize the pressure within all of said assemblies and equalize the force applied to each of said pistons.

10. The apparatus as claimed in claim 9 wherein:

each of said cylinders has a bottom and said passages are positioned to supply hydraulic fluid to said cylinders adjacent said bottom, and each of said pistons includes means for spacing the bottom of said piston apart from the bottom of said cylinder to allow hydraulic pressure always to act on said bottom of said piston.

11. The apparatus as claimed in claim 10 wherein:

each of said pistons has formed therein a longitudinal bore connecting the bottom and top of said piston for bleeding air from each of said cylinders and means for plugging said bore.

12. The apparatus as claimed in claim 11 wherein:

said piston includes a frusto-conical bottom surface intersecting said bore.

13. The apparatus as claimed in claim 9 including:

means for measuring the pressure within said cylinders.

14. The apparatus as claimed in claim 9 wherein:

each of said pistons includes a first portion extending from said cylinder and a second radially enlarged portion in said cylinder, and said assemblies each include a top cap disposed around said piston and over said cylinder and a vent passage in said top cap for venting space in said cylinder between said second portion and said top cap.

* * * * *